US006458855B1

(12) United States Patent
Wittenbrink et al.

(10) Patent No.: US 6,458,855 B1
(45) Date of Patent: Oct. 1, 2002

(54) FISCHER-TROPSCH PROCESS WATER EMULSIONS OF HYDROCARBONS (LAW548)

(75) Inventors: Robert J. Wittenbrink, Baton Rouge, LA (US); Paul J. Berlowitz, East Windsor, NJ (US); Tapan Chakrabaty, Calgary (CA); Loren L. Ansell, Baton Rouge, LA (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/236,150

(22) Filed: Jan. 22, 1999

Related U.S. Application Data

(63) Continuation of application No. 08/928,238, filed on Sep. 12, 1997, now abandoned.

(51) Int. Cl.[7] ..... B01F 3/08; B01F 17/42; C10L 1/32

(52) U.S. Cl. ..... 516/76; 44/301; 44/302; 137/13; 516/77

(58) Field of Search ..... 44/301, 302; 137/13; 516/76; 208/950

(56) References Cited

U.S. PATENT DOCUMENTS

| | | | | | |
|---|---|---|---|---|---|
| 2,920,948 | A | * | 1/1960 | Weeks | 44/301 |
| 3,425,429 | A | * | 2/1969 | Kane | 137/13 |
| 3,641,181 | A | * | 2/1972 | Robbins et al. | |
| 4,568,480 | A | * | 2/1986 | Thir et al. | 516/76 X |
| 5,348,982 | A | * | 9/1994 | Herbolzheimer et al. | 518/700 |
| 5,545,674 | A | * | 8/1996 | Behrmann et al. | 518/715 |
| 6,284,806 | B1 | * | 9/2001 | Chakrabarty et al. | 516/77 |
| 6,294,587 | B1 | * | 9/2001 | Wittenbrink et al. | 516/76 |

FOREIGN PATENT DOCUMENTS

| | | | |
|---|---|---|---|
| EP | 0209758 | 1/1987 | C10L/1/32 |
| EP | 0363300 | 4/1990 | C10L/1/32 |

* cited by examiner

*Primary Examiner*—Richard D. Lovering
(74) *Attorney, Agent, or Firm*—Jay S. Simon; Charles J. Brumlik

(57) ABSTRACT

Stable hydrocarbon in water emulsions are formed by emulsifying the hydrocarbon with a non-ionic surfactant and water obtained from the Fischer-Tropsch process.

19 Claims, No Drawings

FISCHER-TROPSCH PROCESS WATER EMULSIONS OF HYDROCARBONS (LAW548)

This application is a continuation of and claims benefit of application 08/928,238, filed Sept. 12, 1997, now abandoned.

FIELD OF THE INVENTION

This invention relates to stable, macro emulsions of hydrocarbons in water derived from the Fischer-Tropsch process.

BACKGROUND OF THE INVENTION

Hydrocarbon-water emulsions are well known and have a variety of uses, e.g., as hydrocarbon transport mechanisms, such as through pipelines or as fuels, e.g., for power plants or internal combustion engines. These emulsions are generally described as macro emulsions, that is, the emulsion is cloudy or opaque as compared to micro emulsions that are clear, translucent, and thermodynamically stable because of the higher level of surfactant used in preparing micro-emulsions.

While aqueous fuel emulsions are known to reduce pollutants when burned as fuels, the methods for making these emulsions and the materials used in preparing the emulsions, such as surfactants and co-solvents, e.g., alcohols, can be expensive. Further, the stability of known emulsions is usually rather weak, particularly when low levels of surfactants are used in preparing the emulsions.

Consequently, there is a need for stable, macro emulsions that use less surfactants or co-solvents, or less costly materials in the preparation of the emulsions. For purposes of this invention, stability of macro emulsions is generally defined as the degree of separation occurring during a twenty-four hour period, usually the first twenty-four hour period after forming the emulsion.

SUMMARY OF THE INVENTION

In accordance with this invention a stable, macro emulsion wherein water is the continuous phase is provided and comprises Fischer-Tropsch process water, a hydrocarbon and a non-ionic surfactant. Preferably, the emulsion is prepared in the substantial absence, e.g., ≦2.0 wt %, preferably ≦1.0 wt % or complete absence of the addition of a co-solvent, e.g., alcohols, and preferably in the substantial absence of co-solvent, that is, Fischer-Tropsch process water may contain small amounts of oxygenates, including alcohols; these oxygenates make up less oxygenates than would be present if a co-solvent was included in the emulsion. Generally, the alcohol content of Fischer-Tropsch process water is less that about 2 wt % based on the process water, more preferably less than about 1.5 wt % based on the process water.

The macro-emulsions that are subject of this invention are generally easier to prepare and more stable that the corresponding emulsion with, for example, distilled water or tap water. Using the Fischer-Tropsch process water takes advantage-of the naturally occurring chemicals in the Fischer-Tropsch process water to reduce the amount of surfactant required to prepare stable emulsions.

PREFERRED EMBODIMENTS

The Fischer-Tropsch process can be described as the hydrogenation of carbon monoxide over a suitable catalyst.

Nevertheless, regardless of the non-shifting catalyst employed, water is a product of the reaction.

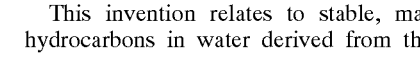

$$2nH_2+nCO \rightarrow C_nH_{2n+2}+nH_2O$$

The Fischer-Tropsch process -water, preferably from a non-shifting process, separated from the light gases and $C_5$+product can generically be described as (and in which oxygenates are preferably ≦2 wt %, more preferably less than about 1 wt %):

| | |
|---|---|
| $C_1$–$C_{12}$ alcohols | 0.05–2 wt %, preferably 0.05–1.2 wt % |
| $C_2$–$C_6$ acids | 0–50 wppm |
| $C_2$–$C_6$ Ketones, aldehydes acetates | 0–50 wppm |
| other oxygenates | 0–500 wppm |

The Fischer-Tropsch process is well known to those skilled in the art, see for example, U.S. Pat. Nos. 5,348,982 and 5,545,674 incorporated herein by reference and typically involves the reaction of hydrogen and carbon monoxide in a molar ratio of about 0.5/1 to 4/1, preferably 1.5/1 to 2.5/1, at temperatures of about 175–400° C., preferably about 180°–240°, at pressures of 1–100 bar, preferably about 10–50 bar, in the presence of a Fischer-Tropsch catalyst, generally a supported or unsupported Group VIII, non-noble metal, e.g., iron, nickel, ruthenium, cobalt and with or without a promoter, e.g. ruthenium, rhenium, hafnium; platinum, palladium, zirconium, titanium. Supports, when used, can be refractory metal oxides such as Group IVB, e.g., titania, zirconia, or silica, alumina, or silica-alumina. A preferred catalyst comprises a non-shifting catalyst, e.g., cobalt or ruthenium, preferably cobalt with rhenium or zirconium as a promoter, preferably cobalt and rhenium supported on silica or titania, preferably titania. The Fischer-Tropsch liquids, i.e., $C_5$+, preferably $C_{10}$+ are recovered and light gases, e.g., unreacted hydrogen and CO, $C_1$ to $C_3$ or $C_4$ and water are separated from the hydrocarbons. The water is then recovered by conventional means, e.g., separation.

The emulsions of the invention are formed by conventional emulsion technology, that is, subjecting a mixture of the hydrocarbon, water and surfactant to sufficient shearing, as in a commercial blender or its equivalent for a period of time sufficient for forming the emulsion, e.g., generally a few seconds. For general emulsion information, see generally, "Colloidal Systems and Interfaces", S. Ross and I. D. Morrison, J. W. Wiley, NY, 1988.

The hydrocarbons that may be emulsified-by the Fischer-Tropsch process water include any materials whether liquid or solid at room temperature, and boiling between about $C_4$ and 1050° F.+, preferably $C_4$-700° F. These materials my be further characterized as fuels: for example, naphthas boiling in the range of about $C_4$-320° F., preferably $C_5$-320° F., water emulsions of which may be used as power plant fuels; transportation fuels, such as jet fuels boiling in the range of about 250–575° F., preferably 300–550° F., and diesel fuels boiling in the range of about 250–700° F., preferably 320–700° F.

The hydrocarbons may be obtained from conventional petroleum sources, shale (kerogen), Fischer-Tropsch hydrocarbons, tar sands (bitumen), and even coal liquids. Preferred sources are petroleum, kerosene and Fischer-Tropsch hydrocarbons that may or May not be hydroisomerized.

Hydroisomerization conditions for Fischer-Tropsch derived hydrocarbons are well known to those skilled in the art. Generally, the conditions include:

| CONDITION | BROAD | PREFERRED |
|---|---|---|
| Temperature, ° F. | 300–900 (149–482° C.) | 550–750 (288–399° C.) |
| Total pressure, psig | 300–2500 | 300–1500 |
| Hydrogen Treat Rate, SCF/B | 500–5000 | 2000–4000 |

Catalysts useful in Hydroisomerization are typically bifunctional in nature containing an acid function as well as a hydrogenation component. A hydrocracking suppressant may also be added. The hydrocracking suppressant may be either a Group 1B metal, e.g., preferably copper, in amounts of about 0.1–10 wt %, or a source of sulfur, or both. The source of sulfur can be provided by presulfiding the catalyst by known methods, for example, by treatment with hydrogen sulfide until breakthrough occurs.

The hydrogenation component may be a Group VIII metal, either noble or non-noble metal. The preferred non-noble metals include nickel, cobalt, or iron, preferably nickel or cobalt, more preferably cobalt. The Group VIII metal is usually present in catalytically effective amounts, that is, ranging from 0.1 to 20 wt %. Preferably, a Group VI metal is incorporated into the catalyst, e.g., molybdenum, in amounts of about 1–20 wt %.

The acid functionality can be furnished by a support with which the catalytic metal or metals can be composited in well known methods. The support can be any refractory oxide or mixture of refractory oxides or zeolites or mixtures thereof. Preferred supports include silica, alumina, silica-alumina, silica-alumina-phosphates, titania, zirconia, vanadia and other Group III, IV, V or VI oxides, as well as Y sieves, such as ultra stable Y sieves. Preferred supports include alumina and silica-alumina, more preferably silica-alumina where the silica concentration of the bulk support is less than about 50 wt %, preferably less than about 35 wt %, more preferably 15–30 wt %. When alumina is used as the support, small amounts of chlorine or fluorine may be incorporated into the support to provide the acid functionality.

A preferred support catalyst has surface areas in the range of about 180–400 $m^2$/gm, preferably 230–350 $m^2$/gm, and a pore volume of 0.3 to 1.0 ml/gm, preferably 0.35 to 0.75 ml/gm, a bulk density of about 0.5–1.0 g/ml, and a side crushing strength of about 0.8 to 3.5 kg/mm.

The preparation of preferred amorphous silica-alumina microspheres for use as supports is described in Ryland, Lloyd B., Tamele, M. W., and Wilson, J. N., Cracking Catalysts, Catalysis; Volume VII, Ed. Paul H. Emmett, Reinhold Publishing Corporation, New York, 1960.

During hydroisomerization, the 700° F.+ conversion to 700° F.− ranges from about 20–80%, preferably 30–70%, more preferably about 40–60%; and essentially all olefins and oxygenated products are hydrogenated.

The catalyst can be prepared by any well known method, e.g., impregnation with an aqueous salt, incipient wetness technique, followed by drying at about 125–150° C. for 1–24 hours, calcination at about 300–500° C. for about 1–6 hours, reduction by treatment with a hydrogen or a hydrogen containing gas, and, if desired, sulfiding by treatment with a sulfur containing gas, e.g., $H_2S$ at elevated temperatures. The catalyst will then have about 0.01 to 10 wt % sulfur. The metals can be composited or added to the catalyst either serially, in any order, or by co-impregnation of two or more metals.

The hydrocarbon in water emulsions generally contain at least about 10 wt % hydrocarbons, preferably 30–90 wt %, more preferably 50–70 wt % hydrocarbons.

A non-ionic surfactant is usually employed in relatively low concentrations vis-a-vis petroleum derived liquid emulsions. Thus, the surfactant concentration is sufficient to allow the formation of the macro, relatively stable emulsion. Preferably, the amount of surfactant employed is at least 0.001 wt % of the total emulsion, more preferably about 0.001 to about 3 wt %, and most preferably 0.01 to less than 2 wt %.

Typically, non-ionic surfactants useful in preparing the emulsions of this invention are those used in preparing emulsions of petroleum derived or bitumen derived materials, and are well know to those skilled in the art. Useful-surfactants for this invention include alkyl ethoxylates, linear alcohol ethoxylates, and alkyl glucosides. A preferred emulsifier is an alkyl phenoxy polyalcohol, e.g., nonyl phenoxyl poly (ethyleneoxy ethanol), commercially available under the trade name Igepal.

The following examples will serve to illustrate but not limit this invention.

EXAMPLE 1

A mixture of hydrogen and carbon monoxide synthesis gas ($H_2$:CO 2.11–2.16) was converted to heavy paraffins in a slurry Fischer-Tropsch reactor. A titania supported cobalt/rhenium catalyst was utilized for the Fischer-Tropsch reaction. The reaction was conducted at 422–428° F., 287–289 psig, and the feed was introduced at a linear velocity of 12 to 17.5 cm/sec. The liquid hydrocarbon Fischer-Tropsch product was isolated in three nominally different boiling streams; separated by utilizing a rough flash. The three boiling fractions which were obtained were: 1) $C_5$ to about 500° F., i.e., F-T cold separator liquid; 2) about 500 to about 700° F., i.e., F-T hot separator liquid, and 3) a 700° F.+ boiling fraction, i.e., a F-T reactor wax. The Fischer-Tropsch process water was isolated from the cold separator liquid and used without further purification.

The detailed composition of this water is listed in Table I. Table 2 shows the composition of the cold separator liquid.

TABLE I

Composition of Fischer-Tropsch Process Water

| Compound | wt % | ppm O |
|---|---|---|
| Methanol | 0.70 | 3473.2 |
| Ethanol | 0.35 | 1201.7 |
| 1-Propanol | 0.06 | 151.6 |
| 1-Butanol | 0.04 | 86.7 |
| 1-Pentanol | 0.03 | 57.7 |
| 1-Hexanol | 0.02 | 27.2 |
| 1-Heptanol | 0.005 | 7.4 |
| 1-Octanol | 0.001 | 1.6 |
| 1-Nonanol | 0.0 | 0.3 |
| Total Alcohols | 1.20 | 5007.3 |
| Acid | wppm | wppm O |
| Acetic Acid | 0.0 | 0.0 |
| Propanoic Acid | 1.5 | 0.3 |
| Butanoic Acid | 0.9 | 0.2 |
| Total Acids | 2.5 | 0.5 |
| Acetone | 17.5 | 4.8 |
| Total Oxygen | | 5012.6 |

TABLE 2

Composition of Fischer-Tropsch Cold Separator Liquid

| Carbon # | Paraffins | Alcohol | ppm O |
|---|---|---|---|
| C5 | 1.51 | 0.05 | 90 |
| C6 | 4.98 | 0.20 | 307 |
| C7 | 8.46 | 0.20 | 274 |
| C8 | 11.75 | 0.17 | 208 |
| C9 | 13.01 | 0.58 | 640 |
| C10 | 13.08 | 0.44 | 443 |
| C11 | 11.88 | 0.18 | 169 |
| C12 | 10.6 | 0.09 | 81 |
| C13 | 8.33 | | |
| C14 | 5.91 | | |
| C15 | 3.76 | | |
| C16 | 2.21 | | |
| C17 | 1.24 | | |
| C18 | 0.69 | | |
| C19 | 0.39 | | |
| C20 | 0.23 | | |
| C21 | 0.14 | | |
| C22 | 0.09 | | |
| C23 | 0.06 | | |
| C24 | 0.04 | | |
| Total | 98.10 | 1.90 | 2211 |

EXAMPLE 2

A 70% oil-in-water emulsion was prepared by pouring 70 ml of cold separator liquid from example 1 onto 30 ml of an aqueous phase containing distilled water and a surfactant. Two surfactants belonging to the ethoxylated nonyl phenols with 15 and 20 moles of ethylene oxide were used. The surfactant concentration in the total oil-water mixture varied from 1500 ppm to 6000 ppm. The mixture was blended in a Waring blender for one minute at 3000 rpm.

The emulsions were transferred to graduated centrifuge tubes for studying the degree of emulsification ("complete" versus "partial") and the shelf stability of the emulsions. "Complete" emulsification means that the entire hydrocarbon phase is dispersed in the water phase resulting in a single layer of oil-in-water emulsion. "Partial" emulsification means that not all the hydrocarbon phase is dispersed in the water phase. Instead, the oil-water mixture separates into three layers: oil at the top, oil-in-water-emulsion in the middle, and water at the bottom. The shelf stability (SS) is defined as the volume percent of the aqueous phase retained in the emulsion after 24 hours. Another measure of stability, emulsion stability (ES) is the volume percent of the total oil-water mixture occupied by the oil-in-water emulsion after 24 hours. The oil droplet size in the emulsion was measured by a laser particle size analyzer.

As shown in Table 3, surfactant A with 15 moles of ethylene oxide (EO) provided complete emulsification of the paraffinic oil in water at concentrations of 3000 ppm and 6000 ppm. Only "partial" emulsifications was possible at a surfactant concentration of 1500 ppm. Surfactant B with 20 moles of EO provided complete emulsification at a concentration of 6000 ppm. Only partial emulsification was possible with this surfactant at a concentration of 3000 ppm. Thus, surfactant A is more effective than surfactant B for creating the emulsion fuel.

The emulsions prepared with surfactant A were more stable than those prepared with surfactant B. The SS and ES stability of the emulsion prepared with 3000 ppm of surfactant A are similar to those of the emulsion prepared with 6000 ppm of surfactant B. After seven days of storage, the complete emulsions prepared with either surfactant released some free water but did not release any free oil. The released water could easily be remixed with the emulsion on gentle mixing. As shown in Table 3, the mean oil droplet size in the emulsion was 8 to 9 $\mu$m.

TABLE 3

Properties of 70:30 (oil:water) emulsion prepared with Distilled Water and Fischer-Tropsch Cold Separator Liquid

| Surfactant Type | Surfactant conc., ppm | Degree of emulsification | Stability SS*(%) | Stability ES*(%) | Mean Diameter, $\mu$ |
|---|---|---|---|---|---|
| A (15EO) | 1500 | Partial | 16 | 24 | — |
| A (15EO) | 3000 | Complete | 89 | 96 | 9.3 |
| A (15EO) | 6000 | Complete | 94 | 98 | 8.2 |
| B (20EO) | 3000 | Partial | 16 | 24 | — |
| B (20EO) | 6000 | Complete | 91 | 97 | 8.6 |

EXAMPLE 3

The conditions for preparing the emulsions in this example are the same as those in Example 2 except that Fischer-Tropsch (F-T) process water from Example 1 was used in place of distilled water.

The emulsion characteristics from this example are shown in Table 4. A comparison with Table 3 reveals the advantages of F-T process water over distilled water. For example, with distilled water, only partial emulsification was possible at a surfactant B concentration of 3000 ppm. Complete emulsification, however, was achieved with Fischer-Tropsch water at the same concentration of the surfactant.

The SS and ES stability of the emulsions prepared with F-T process water are higher than those prepared with distilled water in all the tests. For the same stability, the emulsions prepared with process water requires 3000 ppm of surfactant A, while the emulsion prepared with distilled water needs 6000 ppm of the same surfactant. Evidently, the synergy of the F-T process water chemicals with the added surfactant results in a reduction of the surfactant concentration to obtain an emulsions of desired stability.

The SS and ES stability relates to emulsion quality after 24 hours of storage. Table 5 includes the $t_{10}$ stability data for emulsions prepared with distilled and F-T process water that go beyond 24 hours. The $t_{10}$ stability is defined as the time required to lose 10% of the water from the emulsions. With surfactant A at 3000 ppm, the $t_{10}$ stability for emulsions prepared with distilled water is 21 hours, while the $t_{10}$ stability for emulsions prepared with process water is 33 hours.

Thus, these examples clearly show the benefit of preparing emulsions with F-T process water.

TABLE 4

Properties of 70:30 (oil:water) emulsions prepared with Fischer-Tropsch Process Water Using Fischer-Tropsch Cold Separator Liquid

| Surfactant Type | Surfactant conc., ppm | Degree of emulsification | Stability SS*(%) | Stability ES*(%) | Mean Diameter, $\mu$ |
|---|---|---|---|---|---|
| A (15EO) | 1500 | Partial | 20 | 35 | — |
| A (15EO) | 3000 | Complete | 94 | 98 | 7.8 |
| A (15EO) | 6000 | Complete | 97 | 99 | 6.6 |

TABLE 4-continued

Properties of 70:30 (oil:water) emulsions prepared with Fischer-Tropsch Process Water Using Fischer-Tropsch Cold Separator Liquid

| Surfactant Type | Surfactant conc., ppm | Degree of emulsification | Stability SS*(%) | Stability ES*(%) | Mean Diameter, $\mu$ |
|---|---|---|---|---|---|
| B (20EO) | 3000 | Partial | 30 | 78 | 15.6 |
| B (20EO) | 6000 | Complete | 95 | 98 | 7.6 |

TABLE 5

Comparison of F-T Process and Distilled Water in Relation to Emulsion Quality for Fischer-Tropsch Cold Separator Liquid

| Surfactant Type | Surfactant conc., ppm | $t_{10}$* (hrs) Distilled Water | Process Water |
|---|---|---|---|
| A (15E) | 1500 | 0.3 | 0.3 |
| A (15EO) | 3000 | 20.8 | 32.7 |
| A (15EO) | 6000 | 31.6 | 44.1 |
| B (20EO) | 3000 | 0.0 | 1.5 |
| B (20EO) | 6000 | 25.6 | 34.7 |

*SS is the percent of the original aqueous phase which remains in the emulsion after 24 hours.
*ES is the percent of the mixture which remains an emulsion after 24 hours.
*$t_{10}$ is the time required for a 10% loss of the aqueous phase from the emulsion.

What is claimed is:

1. A hydrocarbon in water emulsion comprising a hydrocarbon boiling in the range $C_4$ to 1050° F., Fischer-Tropsch process water, and 1500–6000 ppm of a non-ionic surfactant.

2. An emulsion according to claim 1 characterized by the substantial absence of added co-solvent.

3. An emulsion according to claim 1 characterized by the hydrocarbon boiling in the range $C_4$-700° F.

4. An emulsion according to claim 3 characterized in that the hydrocarbon is selected from the group consisting of $C_4$-320° F. naphthas, 250–575° F. jet fuels, and 250–700 F. diesel fuels.

5. An emulsion according to claim 3 characterized in that the Fischer-Tropsch process water contains ≦2 wt % oxygenates.

6. An emulsion according to claim 1 characterized in that the shelf stability of the emulsion is higher than the shelf stability of a similar emulsion prepared with distilled water.

7. An emulsion according to claim 1 characterized in that the emulsion stability of the emulsion is higher than the emulsion stability of a similar emulsion prepared with distilled water.

8. An emulsion according to claim 1 characterized in that the time required to lose 10% of the water from the emulsion ($t_{10}$ stability) is greater than the $t_{10}$ stability of a similar emulsion prepared with distilled water.

9. An emulsion according to claim 8 characterized in that the Fischer-Tropsch process water is obtained from a $C_5$-500° F. fraction product of a non-shifting Fischer-Tropsch process.

10. A hydrocarbon in water emulsion containing a hydrocarbon boiling in the range $C_4$ to 1050° F., Fischer-Tropsch process water, <2 wt % of a non-ionic surfactant, and <2 wt % of a co-solvent.

11. An emulsion according to claim 10 containing 1500–6000 ppm of the non-ionic surfactant.

12. An emulsion according to claim 11 characterized by the hydrocarbon boiling in the range $C_4$-700° F.

13. An emulsion according to claim 11 containing 3000–6000 ppm of the non-ionic surfactant.

14. An emulsion according to claim 13 characterized in that the hydrocarbon is selected from the group consisting of $C_4$-320° F. naphthas, 250–575° F. jet fuels, and 250–700° F. diesel fuels.

15. An emulsion according to claim 14 characterized in that the Fischer-Tropsch process water contains ≦2 wt % oxygenates.

16. An emulsion according to claim 11 characterized in that the shelf stability of the emulsion is higher than the shelf stability of a similar emulsion prepared with distilled water.

17. An emulsion according to claim 11 characterized in that the emulsion stability of the emulsion is higher than the emulsion stability of a similar emulsion prepared with distilled water.

18. An emulsion according to claim 11 characterized in that the time required to lose 10% of the water from the emulsion ($t_{10}$ stability) is greater than the $t_{10}$ stability of a similar emulsion prepared with distilled water.

19. An emulsion according to claim 18 characterized in that the Fischer-Tropsch process water is obtained from a $C_5$-500° F. fraction product of a non-shifting Fischer-Tropsch process.

* * * * *